United States Patent [19]

Hilton

[11] Patent Number: 4,938,123

[45] Date of Patent: Jul. 3, 1990

[54] WIND DIRECTING ASSEMBLY FOR A BOAT HATCH OR LIKE STRUCTURE

[76] Inventor: Lin Hilton, 2816 NE. 25th Ct., Ft. Lauderdale, Fla. 33305

[21] Appl. No.: 439,252

[22] Filed: Nov. 17, 1989

[51] Int. Cl.[5] ..... B60H 1/26

[52] U.S. Cl. ..... 98/37; 114/211

[58] Field of Search ..... 98/2, 14, 13, 37, 64; 114/211

[56] References Cited

U.S. PATENT DOCUMENTS

| | | | |
|---|---|---|---|
| 49,374 | 8/1865 | Burnett | 114/211 |
| 59,264 | 10/1866 | Raymond | 98/64 |
| 3,757,664 | 9/1973 | Jalbert | 98/37 |
| 4,448,112 | 5/1984 | Jöderberg | 114/211 X |
| 4,706,593 | 11/1987 | Vail, Jr. | 98/37 X |
| 4,759,271 | 7/1988 | Bliemeister | 98/37 |

FOREIGN PATENT DOCUMENTS

| | | | |
|---|---|---|---|
| 8700442 | 9/1988 | Netherlands | 98/37 |
| 202221 | 8/1923 | United Kingdom | 114/211 |

*Primary Examiner*—Harold Joyce

*Attorney, Agent, or Firm*—Malloy & Malloy

[57] ABSTRACT

A wind or breeze directing assembly used to direct air into and through the hatch of a boat or through any type of opening into the interior of a given structure comprising a frame supporting a plurality of interconnected panels movable relative to one another for selective positioning between an operative and a stored position and constructed to be essentially self-supporting relative to the opening with no moving parts and unattached to any other supporting structure such as a halyard or the like on a boat.

16 Claims, 2 Drawing Sheets

FIG. 1
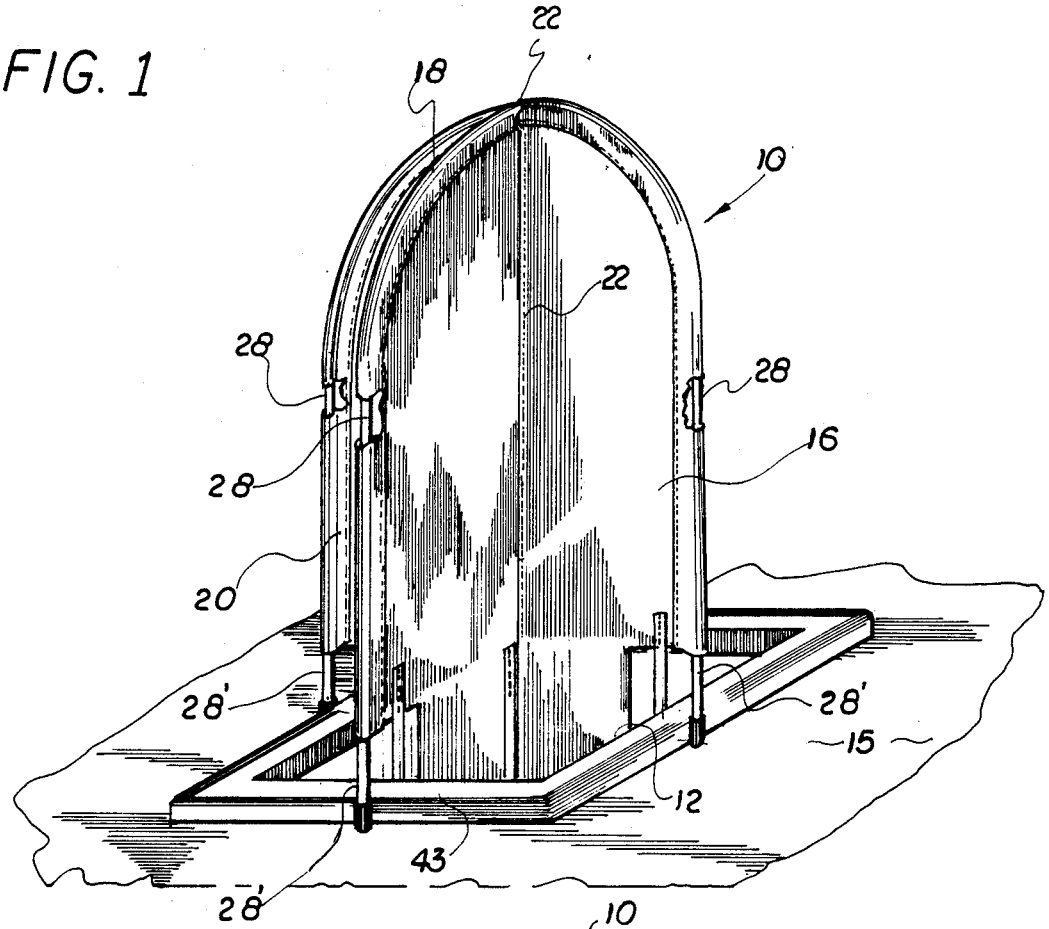
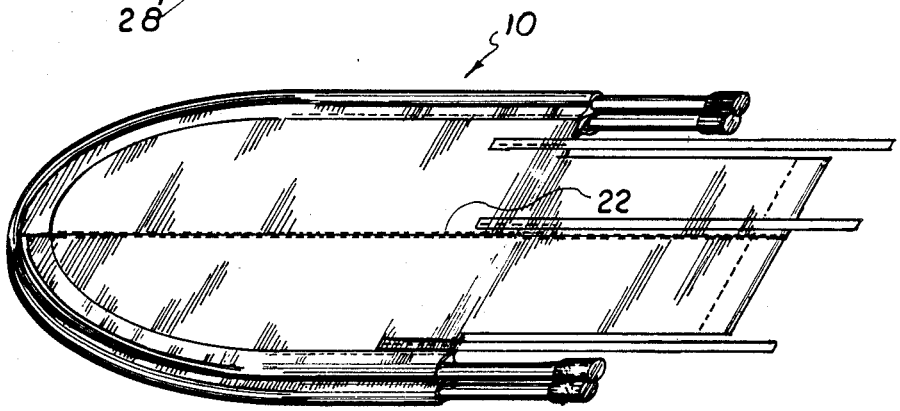
FIG. 2

FIG. 3
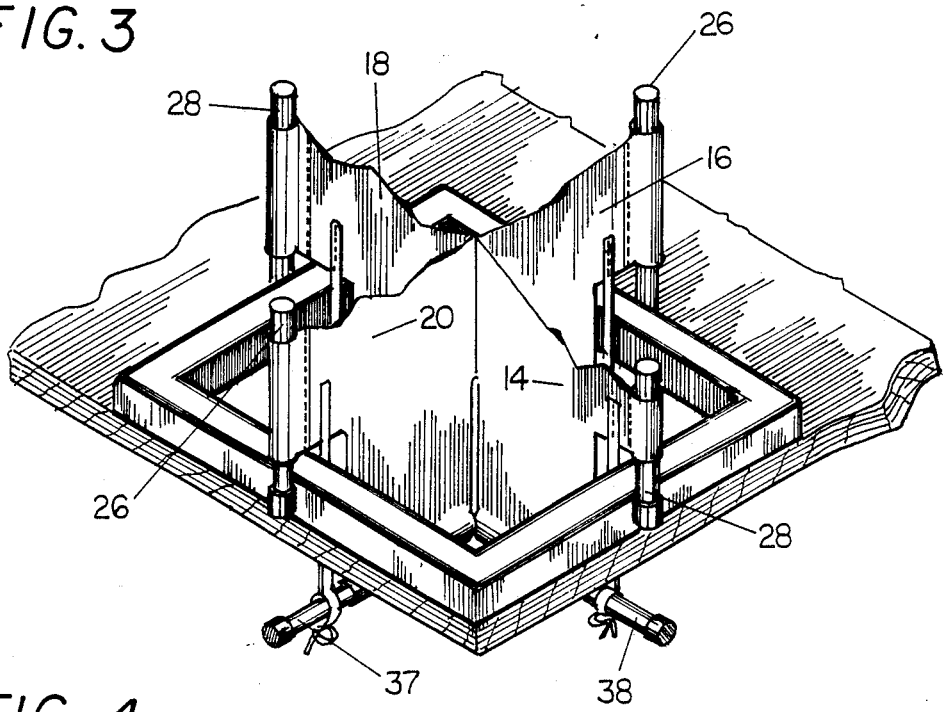
FIG. 4
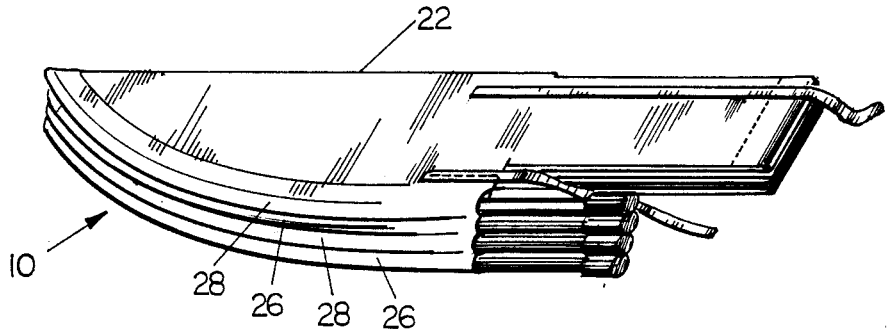
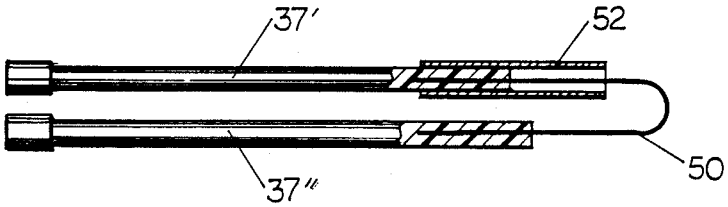
FIG. 5

WIND DIRECTING ASSEMBLY FOR A BOAT HATCH OR LIKE STRUCTURE

BACKGROUND OF THE INVENTION

1. Field of the Invention

This invention relates to a wind directing apparatus for directing air into the interior of a structure, such as a marine craft through an opening such as a hatch on the deck of the marine craft.

2. Description of the Prior Art

In boats, including sailing boats, power boats, and like marine craft, the interior thereof is frequently not air conditioned. Accordingly, ventilation of the interior of various types of boats which include living space below deck is frequently a problem, especially when the marine craft is not moving. In order to overcome such a problem, developments in the prior art include various types of ventilator or wind deflecting or directing assemblies which are specifically structured for use on a marine craft and which are intended to "capture" or more specifically, direct air from the exterior of the craft down through an opening, such as an open hatch, port, or the like, into the interior of the craft. Such prior art devices are evidenced in the following U.S. Patents. Bliemeister discloses a wind deflecting ventilator comprising an open frame attached to a fabric scoop like receptacle for turning the direction of moving air down an open hatch on a boat. A plurality of cords are attached to a supporting frame for securement to an open hatch or like structure. This device, however, is primarily used to direct wind from a single direction rather than be efficiently operable to direct air into the interior of the structure regardless of the direction of the breeze or wind.

Vail discloses a swiveling wind scoop for ventilating the enclosed interior area of a boat through a hatch opening and comprising a flexible sail for continuously directing air flow regardless of the direction of travel of the boat. A mast for rotatably supporting the sail above the hatch opening is fastened above the opening. A supporting or mounting base is strapped or otherwise secured about the open hatch for bracing and support of the structure.

The references to Beck, U.S. Pat. No. 3,741,100; Fuerst, U.S. Pat. No. 4,050,363; Knight, U.S. Pat. No. 3,013,483; and Hunt, U.S. Pat. No. 1,115,315 are all directed to a scoop or air directing type of structure which has a generally fixed or rigid structural configuration and which is designed to primarily direct air coming from a single direction into the interior of the boat or like structure on which it is mounted by means of a hole leading to such interior.

Other prior art devices are represented in the following U.S. Patents which are directed to the same problem as set forth above but which are not specifically directed for use with a marine craft or the like. None of these structures are specifically adaptable to be selectively and easily positionable in both an operative and stored position since the majority of such structures are made from a somewhat rigid material and are intended to provide a fixed mounting over some type of ventilating opening into the interior of various types of structures. Such patents include Murray, U.S. Pat. No. 4,730,552; Comte, U.S. Pat. No. 4,241,645; Burns, U.S. Pat. No. 4,111,106; McIntosh, U.S. Pat. No. 4,535,715; and Jalbert, U.S. Pat. No. 3,757,664.

While the structures disclosed above are generally representative of prior art attempts to solve the above-noted problem, none are specifically capable of efficiently providing a stable structure capable of directing a breeze or air coming from any direction into the interior of a boat through an open hatch while providing no moving parts and which is effectively self-supporting and also adaptable for the ventilating of other types of structures other than boats.

SUMMARY OF THE INVENTION

This invention relates to a wind directing apparatus or ventilating assembly specifically designed to direct air down through an open hatch on the deck of a boat into the interior thereof. While the subject invention is described primarily for use on marine craft in the manner set forth above, it is not limited to such use and could easily be adapted, and still remain within the intended scope of the present invention for use on other structures such as buildings, other vehicles, etc.

The subject invention includes a support frame comprising a plurality of legs each made of a material of sufficient flexibility to be bent about itself. Each of the elongated legs terminate in oppositely disposed free ends.

A plurality of preferably flexible material panels, which could easily be made of sail cloth or the like, are movably interconnected to one another and supported by the plurality of legs defining the support frame. The panels are joined along a common, substantially centrally disposed seam and each panel extends radially outward therefrom terminating at an outer peripheral edge.

A connecting means is provided, preferably along the outer peripheral edge of each panel so as to interconnect such panel along such edge to the length of one of the legs. The panels each include an upper portion and a lower portion. The connecting means extends around the entire peripheral edge of the upper portion of each panel and terminates at a point in spaced relation above the free ends of the legs when fitted thereto, thus defining the upper portion of the panels. The lower portion of each panel extends down from the upper portion and terminates at a bottom edge when in the operative position is disposed below the free ends of the legs. The bottom edge of each panel includes a sleeve extending along its length and being specifically designed to partially surround and maintain one of a plurality of mounting arms passing therethrough. Due to the common interconnection along the central seam, the panels are movable relative to one another. This movement allows for selective positioning between an operative position such as when the assembly is mounted in operative relation to an open hatch or a stored position.

The aforementioned operative position is defined by essentially a transverse, intersecting relation of each of the panels. The opposite free ends of the legs extend outwardly from a lower or inner end of the assembly, when in its operative position for securement or mounting on the deck or other supporting surface about the open hatch leading to the interior of the structure on which the subject assembly is mounted. The lower portion of the panels normally extends through the hatch opening and into the interior of the structure. The U-shaped configuration in which each of the legs may be bent allows interconnecting of oppositely disposed panels to a common one of the legs. The upper portion of the assembly therefore comprises a somewhat multiarcuate configuration since the panels do in fact intersect one another. Each of the mounting arms has a generally straight, linear configuration so as to permit passage through the sleeves along the bottom edge of oppositely disposed panels with the opposite ends of each arm extending outwardly from the opposite sleeves. In this manner, an effective cross is formed between two mounting arms when the assembly is in the operative position. Each of the mounting arms is of a length greater than the width of the hatch opening so as to engage with the inner surrounding surface about the hatch opening upon applying an upward force to the mounting arms from above the hatch. Once assembled, the apparatus is mounted in substantially overlying, outwardly extending relation to the open hatch. The existence of the radially extending outwardly disposed upper portion of the panels allows for the channeling or directing of air down to the lower portion of the panels disposed below the hatch opening, thereby directing the air into the interior below the open hatch regardless of the incoming direction of the air or breeze or whether the marine craft on which the assembly is mounted is traveling or anchored.

Other structural features of the present invention include brace means preferably in the form of flexible material strips or other applicably structured connectors secured to a bottom edge of the upper and lower portions of each panel and having a sufficient length to extend downwardly therefrom and through the hatch opening for attachment to a mounting arm associated with such oppositely disposed panels. The effective cross formed formed by the mounting arms serves to secure the brace means allowing a downward force to be applied to the legs of the support frame forcing the legs into the deck surrounding the hatch while at the same time, pulling the mounting arms upwardly against the inner surrounding surface of the hatch opening, thereby effecting a self-supported mounting. The flexible material strips of the brace means, when pulled tight and secured to the mounting arms, act so as to pull downwardly on the panels making them rigid and thus, creating a more suitable wind directing surface.

BRIEF DESCRIPTION OF THE DRAWINGS

For a fuller understanding of the nature of the present invention, reference should be had to the following detailed description taken in connection with the accompanying drawings in which:

FIG. 1 is a perspective view of the assembly of the present invention in an operative position relative to an opening in a given structure.

FIG. 2 is a perspective view of the assembly of the present invention shown in a collapsed, stored position.

FIG. 3 is a partial perspective view of the assembly of the present invention in cut-away illustrating the self-supported mounting.

FIG. 4 is a perspective view of the assembly of an alternative embodiment of the invention shown in a collapsed, stored position.

FIG. 5 is a detailed view of one mounting arm shown in a collapsed position for storage.

Like reference numerals refer to like parts throughout the several views of the drawings.

DETAILED DESCRIPTION OF THE PREFERRED EMBODIMENT

As shown in FIGS. 1 through 4, the present invention is directed towards a ventilator or wind directing assembly generally indicated as 10. The assembly 10 is designed to fit over and extend outwardly from within an opening, such as an open hatch 12 which may be associated with a boat or like structure. Naturally, the assembly 10 of the present invention is easily adaptable for use in ventilating other structures other than boats.

The assembly 10 comprises a plurality of panels, preferably but necessarily four in number as at 14, 16, 18 and 20. Each of the panels are interconnected to one another along a common, substantially centrally disposed seam 22 extending from an inner most end as at 22' to an outer most end as at 22".

A support frame is provided to support and maintain each of the panels in a preferred, operative position as represented in FIG. 1. Such support frame includes a plurality of flexible material legs 26 and 28 of sufficient length to extend in supporting engagement with the outer periphery of oppositely disposed ones of the plurality of panels. In addition, each of the legs 26 and 28 has sufficient flexibility to be bent about its own length into a somewhat U-shaped configuration. The length and flexibility of each leg therefore allows its attachment to the outer peripheral edge of each oppositely disposed panel. For example, oppositely disposed panels 16 and 20 are connected along different portions of the length of the same leg 28. Similarly, oppositely disposed panels 14 and 18 are connected along different portions of the length of a common or same leg 26. Interconnection between the peripheral edge of a given panel preferably occurs by a connecting means generally indicated as 32 in the form of an elongated sleeve formed on and defining the peripheral edge of each of the given panels. Each of the sleeves are dimensioned and configured to allow the passage of a portion of the length of an appropriately positioned leg as at 26 therethrough.

The free ends defining the opposite longitudinal ends of each of the legs as at 26' and 28' extend outwardly from the inner or bottom end of the respective panel and are fitted with caps 27 for supporting engagement on a given surface 15 in surrounding relation or immediately adjacent to the hatch opening 12.

Each of the panels is constructured so as to comprise an upper portion as at 14' and 16' and also a lower portion as at 14" and 16" shown in FIGS. 1 and 2. The lower portions 14" and 16" as shown in FIG. 1 extend downwardly from an inner end 24 and 25 of the upper portions 14' and 16' so as to extend through the hatch opening 12 and into the interior structure. The bottom transverse edges 34 of each lower portion are fitted with sleeves 35 and 36 which are specifically designed to surround and maintain mounting arms 37 and 38 as shown in FIG. 3. The mounting arms are generally of an elongated linearl configuration having a length greater than that of the width of the hatch opening 12 and are adapted to engage an inner surface of the deck 15 about the hatch opening 12 within the interior structure when the assembly is in the operative position.

Other structural features include brace means comprising a plurality of elongated straps or like connectors 40 and 42 wherein a first set of straps 42 is attached to the centrally disposed seam 22 as at 44 in FIG. 2 and a second set of straps 40 are secured to the upper portion of the panels adjacent to the connecting means as at 45 in FIG. 2. These elongated straps are adapted to be tied to the mounting arms in such a manner so as to pull down on the legs 26 and 28 forcing the free ends 26' and 28' tightly against the outer surface of the deck 15 while at the same time, pulling the mounting arms upwardly so as to engage with an underside of the deck 15 thereby effecting a self-supporting mount having no moving parts extending therefrom.

Also, due to the fact that the panels are movable or pivotal relative to one another about the central seam 22, the assembly 10 is readily collapsible into a stored position as shown in FIG. 2. This stored position is generally defined by a substantially flat overall orientation and a somewhat parallel or immediately adjacent side by side engagement of the next adjacent panels, again as shown in FIG. 2.

An alternative embodiment to that shown in FIG. 2, is the embodiment shown in FIG. 4, wherein the panels of the assembly 10 are readily collapsible onto one another with all the legs stacked opposite to the central seam 22.

A further embodiment of the present invention includes a collapsible mounting arm as shown in FIG. 5 having a first section 37' and a second section 37" and connected at their ends by a flexible wire or like structure 50. In use, the first section 37' and the second section 37" are placed in a linear configuration with respect to one another so that the flexible wire 50 is relatively straight whereupon a connecting collar 52 slideably engages around an outer surface of the opposing ends of the two sections so as to form a one piece linear mounting arm.

Now that the invention has been described,

What is claimed is:

1. A wind directing assembly for directing air to and thereby ventilating the interior of a structure through an opening such as a boat hatch, said assembly comprising:

(a) a support frame including a plurality of legs disposed in spaced relation to one another and including end portions mounted about the opening, (b) a plurality of panels each interconnected along a substantially center seam line and extending radially outward therefrom, each of said panels comprising an upper portion and a lower portion, (c) each of said panels being connected in supported attachment along an outer longitudinal edge to one of said plurality of legs of said support frame, said outer longitudinal edge extending about the periphery of said upper portion, (d) said support frame and said upper portion of said plurality of panels extending outwardly from the opening in substantially overlying relation thereto and said plurality of panels disposed to direct air downwardly to said lower portion, (e) said lower portion of said plurality of panels extending downward from said upper portion and passing through the opening, said lower portion disposed to direct airflow through said opening and into an interior space, (f) said lower portion on said plurality of panels including a bottom transverse edge defined by a hollow sleeve extending therealong, (g) at least two elongate mounting arms extending through said hollow sleeves, each individual one of said elongate mounting arms extending through said sleeves on an oppositely disposed pair of said panels and having opposite free ends protruding therefrom, and (h) brace means attached to said plurality of panels and being adapted for connecting engagement with said elongate mounting arms so as to apply a downward force on said support frame and an upward force on said elongate mounting arms when said assembly is mounted about the opening.

2. An assembly as in claim 1 wherein said end portions extend outwardly from said outer longitudinal edge of said upper portion of said plurality of panels and are relatively disposed to secure said support frame and panels thereon about the opening.

3. An assembly as in claim 1 wherein said upper portion of said plurality of panels are attached to outer end portions of said frame means oppositely disposed to said lower portion of said plurality of panels and defining an outer end of said assembly.

4. An assembly as in claim 3 wherein each of said upper portion of said plurality of panels are connected to one of said legs substantially continuously along its length from said outer end to an inner end thereof and in spaced relation to said end portions.

5. An assembly as in claim 1 wherein said plurality of panels are movable relative to one another about said central seam.

6. An assembly as in claim 5 wherein said panels and said legs attached thereto are positionable into a stored position defined by a substantially flat configuration and a substantially parallel orientation of adjacent ones of said panels.

7. An assembly as in claim 6 wherein said panels are selectively positionable in an operative position defined by a transverse, intersecting orientation of said plurality of panels and said legs attached thereto.

8. An assembly as in claim 6 wherein said panels are formed of a substantially flexible material and said legs are formed of a material of sufficient flexibility to be bent along their respective lengths.

9. An assembly as in claim 1 wherein each of said legs comprises an elongated configuration terminating at opposite free ends having caps fitted thereto and formed of a material of sufficient flexibility to be bent along its length into a substantially U-shaped configuration oppositely disposed ones of said end portions defined by said free ends of a common one of said legs.

10. An assembly as in claim 9 wherein oppositely disposed ones of said upper portion of said panels are secured continuously along an outer peripheral edge thereof to a common one of said legs.

11. An assembly as in claim 10 wherein said lower portion of said panels extends downward from said upper portion and includes said brace means fitted thereto.

12. An assembly as in claim 11 wherein said bottom transverse edge of said lower portion on each of said panels includes said sleeves formed along the length thereof, each of said sleeves dimensioned to receive a partial length of one of said mounting arms therein.

13. An assembly as in claim 10 wherein said panels are selectively positionable in an operative position defined by a transverse, intersecting orientation of said plurality of panels with said legs attached thereto and said mounting arms extending throughs aid oppositely disposed sleeves along the bottom transverse edge of said lower portion.

14. An assembly as in claim 1 wherein said brace means includes a first set of elongated flexible straps fitted to said center seam line and a second set of elongated flexible straps fitted to said upper portion of said panels.

15. An assembly as in claim 14 wherein said first said set of elongated flexible straps are adapted to be secured about an intersection of said mounting arms when said assembly is in the operative position.

16. An assembly as in claim 14 wherein said second set of elongated flexible straps are fitted to said inner end of said upper portion and are adapted to be secured to one of said opposite free ends of said mounting arms extending from said sleeves.

* * * * *